United States Patent [19]

Gilbride

[11] Patent Number: 4,732,645

[45] Date of Patent: Mar. 22, 1988

[54] SHOE SUBSTRATE REINFORCING MACHINE

[75] Inventor: Andrew J. Gilbride, Swampscott, Mass.

[73] Assignee: DVSG Patentverwaltungs G.m.b.H., Frankfurt, Fed. Rep. of Germany

[21] Appl. No.: 919,289

[22] Filed: Oct. 15, 1986

[51] Int. Cl.[4] ..... B05C 13/00

[52] U.S. Cl. ..... 156/578; 12/123; 118/503; 269/238

[58] Field of Search ..... 269/303-305, 269/307, 316, 54.5, 238; 156/578; 12/123

[56] References Cited

U.S. PATENT DOCUMENTS 1,522,533 1/1925 Newman et al. ..... 269/304 X 4,502,411 3/1985 Gilbride et al. ..... 269/238 X

*Primary Examiner*—David Simmons

*Attorney, Agent, or Firm*—Owen J. Meegan; Aubrey C. Brine

[57] ABSTRACT

A machine is disclosed for depositing powder in a selected configuration, fusing the deposited powder into a laminate and pressing the fused laminate against a shoe substrate to adhere the fused laminate to the shoe substrate. A shoe substrate to which a fused laminate is to be adhered, supported on a surface and a guide assists an operator in the accurate placement of the shoe substrate on the surface. The guide has a pair of locating surfaces which can be conjointly, horizontally displaced in a first direction toward or away from each other, and independently adjusted horizontally in a direction perpendicular to the first direction.

6 Claims, 3 Drawing Figures

SHOE SUBSTRATE REINFORCING MACHINE

The present invention relates to machines which deposit powder in a selected configuration, fuse the powder into a laminate and adhere the fused laminate to a shoe substrate to reinforce the substrate, and more particularly, to instrumentalities to assist the machine operator to properly locate the shoe substrate on the machine.

In such machines, it is important to accurately locate the substrate so that the fused laminate will be adhered symmetrically at the proper location. Alignment mechanisms such as are disclosed in U.S. Pat. No. 4,607,741 have been utilized for this purpose. Such mechanisms are set for a specific shoe substrate and may be adjusted for different substrates.

It is an object of the present invention to provide an improved substrate alignment structure.

Other objects and advantages of the present invention will become apparent from the following portion of this specification and from the accompanying drawings which illustrate in accordance with the mandate of the patent statutes a presently preferred embodiment incorporating the principles of the present invention.

Referring to the drawings.

Figure 1:
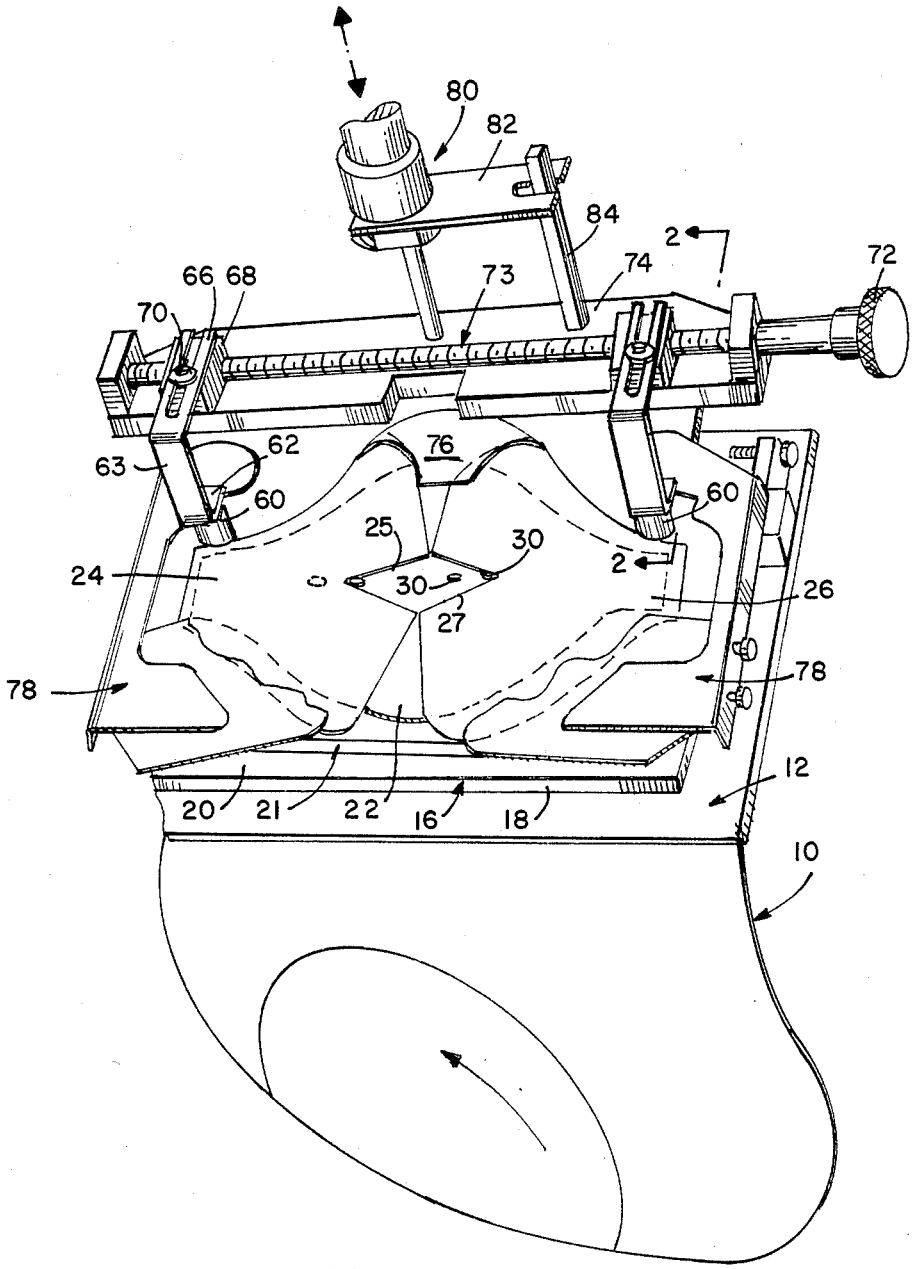
FIG. 1 is a top oblique view of a portion of a rotatable transfer cube of a machine which will deposit powder, fuse the powder into a laminate and adhere the laminate to a shoe substrate.

In state of the art machines which deposit powder in a selected configuration, fuse the powder into a laminate and adhere the fused laminate to a shoe substrate to reinforce the substrate, a rotatable transfer cube 10 having four faces 12 (only the top face shown) sequentially indexes each face from the top horizontal clamp-/unclamp position, counterclockwise through a vertical ready position to a lower horizontal substrate adhering position where the face is pressed downwardly against the fused laminate and then back through the second vertical position to the clamp/unclamp position.

Each transfer cube face 12 has a mounting plate 16 which includes a metallic base 18, a pad of resilient material 20 which is secured to the metallic base 18, a thin pair of firmer resilient material 21 which is secured to the lower pad 20, and a thin layer of Teflon 22 which is secured to the upper pad 21 and which facilitates placement and removal of a pair of shoe substrates 24, 26. The disclosed machine is intended to operate on two families of shoe counters. One of these families 24 has a small back seam notch 25 while the other 26 has a large back seam notch 27. While one of each family is shown placed on the mounting plate 16, for purposes of illustration, identical parts would normally be processed.

Proper placement of these substrates is essential if the fused laminate is to be adhered at the intended location. To this end, four locating pins 30 are used. Each pin is located within a vertical hole which is drilled through the Teflon layer 22, the top pad of resilient material 21, and partially into the lower resilient pad 20. The depth of this hole is selected so that the locating pin 30 will project above the Teflon layer 22 by a distance substantially equal to the thickness of the shoe substrate 26. The outside pair of locating pins 30 are positioned to locate the larger back seam notch 27 and the inside pair of locating pins 30 are positioned to locate the smaller back seam notch 25. When a substrate with a small back seam notch is located, the substrate will overlie the locating pin which would locate the large back seam notch of the other family of substrates. The resilience of the lower pad 20 material below that locating pin 30 permits the pin to be pushed downwardly to the level of the Teflon surface during the pressing of the substrate onto the fused laminate. The fused laminate is so located that it will not be located above the depressed locating pin.

A second locating point for each substrate is provided by locating guides 60 which will abut against an edge of each counter. These guides 60 (FIG. 2) have a threaded vertical shaft 61 which is threadedly received by a threaded hole in the bottom portion 62 of the locating brackets 63 and are retained in position by locknuts 64. The guides have opposed flats 65 so that a turning tool can be used to adjust their height. The locating brackets 63 are slidably displaceable in slots 66 defined in opposing translation nuts 68 to adjust the front to back location of the locating guides. Fasteners 70 secure the brackets 63 to these translation nuts 68. These brackets are also adjustable conjointly side to side by rotating the knurled knob 72 of the translation screw 73 which is mounted on a support plate 74. Once the pair of substrates is located and clamped in position by the heel clamp 76 and the side clamps 78, the entire locating assembly is elevated away from the mounting plate 16 by raising a piston assembly 80. To assure the precise orientation of the support plate 74, a slotted bracket 82 is fixed to the piston assembly 80 and is keyed to a post 84 which extends upwardly from the support plate 74.

The piston assembly 80 is secured to a guide 90 arranged on the front side of a horizontal beam 92 of the machine which is reciprocably movable upwardly and downwardly by means, not shown. The guide 90 comprises a housing 94 which is secured to the beam. A threaded shaft 96 is threadably received through the front portion of the housing, having a control knob 98 on the distal end thereof to effect front to back displacement of the piston assembly 80. A pair of stanchions 100 are attached to the horizontal bar 92 spaced from each side of the housing and an adjustable bolt 102 is threaded through each stanchion 100 into abutting contact with a side wall of the housing to facilitate side to side adjustment of the housing, and hence, the piston assembly 80. Additional details of this guide can be seen in U.S. Pat. No. 4,502,411.

Figure 2:
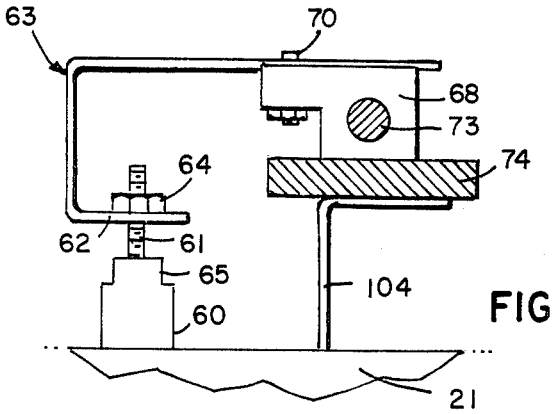
FIG. 2 is a view taken along lines 2—2 of FIG. 1 illustrating one of locating pin assemblies.
Figure 3:
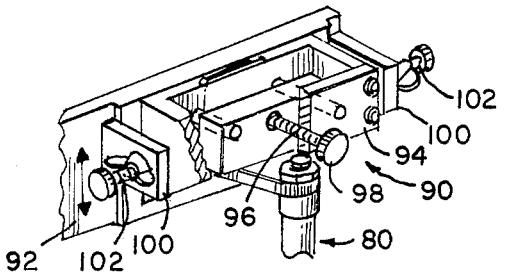
FIG. 3 is an oblique view illustrating the guide which supports the piston assembly shown in FIG. 1.

This permits the lowering of an elongated rear stop plate 104 (FIG. 2 into engagement with the top surface of the upper pad 21 and its front to back placement to engage and stop the shoe substrate or substrates to be processed. The side to side displacement of the piston assembly 80 by the guide 90 permits the relocation of the center of the translating screw whenever such is required as a result of the configuration of the substrate or substrates to be processed.

I claim:

1. A machine for depositing powder in a selected configuration, fusing the deposited powder into a laminate and pressing the fused laminate against a shoe substrate to adhere the fused laminate to the shoe substrate comprising:

means for supporting a family of shoe substrates to which a fused laminate is to be adhered, each of said shoe substrates having selectively configured shapes which are to be accurately positioned on said supporting means to properly receive the substrates, said supporting mans including surface means onto which the shoe substrates are to be placed, guide means for assisting an operator in the accurate placement of the shoe substrates on said surface means, said guide means including a pair of locating surface means, means for conjointly, horizontally displacing said pair of locating surface means in a first direction toward or away from each other, means for independently adjusting the horizontal location of each of said locating surface means in a direction perpendicular to said first direction, and means for independently adjusting the vertical location of each of said locating surface means.

2. A machine according to claim 1, wherein said displacing means comprises a translating screw and a pair of translating nuts.

3. A machine according to claim 2, wherein means for independently adjusting the horizontal location of each of said locating surface means comprises a pair of locating brackets, each supporting one of said locating surface means at one end thereof, slot means defined in the top surface of said pair of translating nuts for slidably receiving the other end of said locating brackets, and means for fastening the other end of each of said locating brackets to said translating nuts at any selected location within a selected range of displacement along said translating nuts.

4. A machine according to claim 3, wherein each of said locating surface means includes a threaded portion and the one end of said locating brackets includes a threaded hole for receiving one of said threaded portions.

5. A machine according to claim 3, wherein said guide means further comprises a rear stop member.

6. A machine according to claim 5, further comprising means for adjusting the side to side and front to back location of said guide means.

* * * * *